US010643552B2

(12) United States Patent
Hsu

(10) Patent No.: US 10,643,552 B2
(45) Date of Patent: May 5, 2020

(54) ELECTRONIC DEVICE AND DISPLAY SCREEN ADJUSTMENT METHOD

(71) Applicant: Chiun Mai Communication Systems, Inc., New Taipei (TW)

(72) Inventor: Chen-Sheng Hsu, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 0 days.

(21) Appl. No.: 16/004,527

(22) Filed: Jun. 11, 2018

(65) Prior Publication Data

US 2019/0130871 A1 May 2, 2019

(30) Foreign Application Priority Data

Oct. 31, 2017 (CN) ..... 2017 1 1048003

(51) Int. Cl.
*G09G 3/34* (2006.01)
*G09G 5/10* (2006.01)
*G09G 3/36* (2006.01)

(52) U.S. Cl.
CPC ..... *G09G 3/342* (2013.01); *G09G 3/3607* (2013.01); *G09G 5/10* (2013.01); *G09G 3/3406* (2013.01); *G09G 2320/0233* (2013.01); *G09G 2320/0285* (2013.01); *G09G 2330/10* (2013.01); *G09G 2360/147* (2013.01)

(58) Field of Classification Search
CPC . G02F 1/133615; G02B 6/0088; G02B 6/009; G09G 3/3406; G09G 2320/0233; G09G 2360/16; G09G 3/3648; G09G 2320/0626; G09G 3/36
See application file for complete search history.

(56) References Cited

U.S. PATENT DOCUMENTS 8,845,170 B2 * 9/2014 Kim ..... G02B 6/003 362/608
2003/0160911 A1 * 8/2003 Kano ..... G02B 6/0028 349/65
2010/0141572 A1 * 6/2010 Kamada ..... G02B 6/0008 345/102
2011/0285763 A1 * 11/2011 Bassi ..... G06T 5/008 345/694
2012/0050339 A1 * 3/2012 Huang ..... G09G 3/342 345/690
2012/0281027 A1 * 11/2012 Kim ..... G09G 3/3406 345/690

(Continued)

FOREIGN PATENT DOCUMENTS

CN 103988121 A 8/2014
CN 105575367 A 5/2016

*Primary Examiner* — Sanjiv D. Patel
(74) *Attorney, Agent, or Firm* — ScienBiziP, P.C.

(57) ABSTRACT

A display screen adjustment method, applied in a display screen includes a display module. The display screen adjustment method includes steps of: displaying a preset picture in a display area of the display module; dividing the display area into a plurality of subareas; detecting whether a brightness of the display area is uniform; determining which subareas have higher brightness than the other subareas; and decreasing light transmittances of pixels in the subareas having higher brightness to offset additional brightness of the pixels that is caused by light leaking of the pixels. An electronic device is also provided.

1 Claim, 5 Drawing Sheets

(56) References Cited

U.S. PATENT DOCUMENTS

| | | | | |
|---|---|---|---|---|
| 2014/0285751 | A1 | 9/2014 | Min et al. | |
| 2014/0327704 | A1* | 11/2014 | Wei | G09G 3/3406 345/690 |
| 2017/0263198 | A1 | 9/2017 | Zhu et al. | |
| 2017/0365225 | A1* | 12/2017 | Yoneyama | G02F 1/133603 |

* cited by examiner

ELECTRONIC DEVICE AND DISPLAY SCREEN ADJUSTMENT METHOD

FIELD

The disclosure generally relates to a display, and particularly to an electronic device and a display screen adjustment method.

BACKGROUND

A display screen on electronic devices can show various types of information to users, such as text, picture, or video. Generally, liquid crystal displays use light emitting diodes as backlight source. Pixels of the display screen may tend to uneven brightness as the backlighting scatters at the edge of the display screen, or because of the high brightness of the light emitting diode itself. To resolve the problem, a black plastic frame can be employed to improve the brightness uniformity of the display screen, but this can result in an overall brightness decrease.

BRIEF DESCRIPTION OF THE DRAWINGS

Many aspects of the present disclosure can be better understood with reference to the drawings. The components in the drawings are not necessarily drawn to scale, the emphasis instead being placed upon clearly illustrating the principles of the disclosure. Moreover, in the drawings, like reference numerals designate corresponding parts throughout the views.

DETAILED DESCRIPTION

Figure 1:
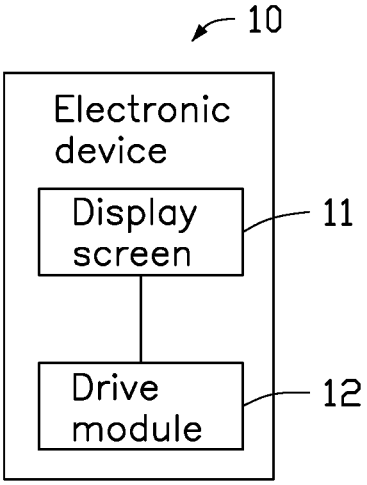
FIG. 1 is a functional block diagram of an embodiment of an electronic device.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiment described herein can be practiced without these specific details. In other instances, methods, procedures, and components have not been described in detail so as not to obscure the related relevant feature being described. Further, the description is not to be considered as limiting the scope of the embodiments described herein. The drawings are not necessarily to scale and the proportions of certain parts may be exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

FIG. 1 shows an electronic device 10 in accordance with an embodiment. The electronic device 10 includes, but is not limited to, a display screen 11 and a drive module 12. In this embodiment, the electronic device 10 can be a telephone, a computer, a monitor, or the like. The display screen 11 can be a curved display screen, a flat display screen, or an odd-shaped display screen. The drive module 12 is a circuit driving the display screen 11.

Figure 2:
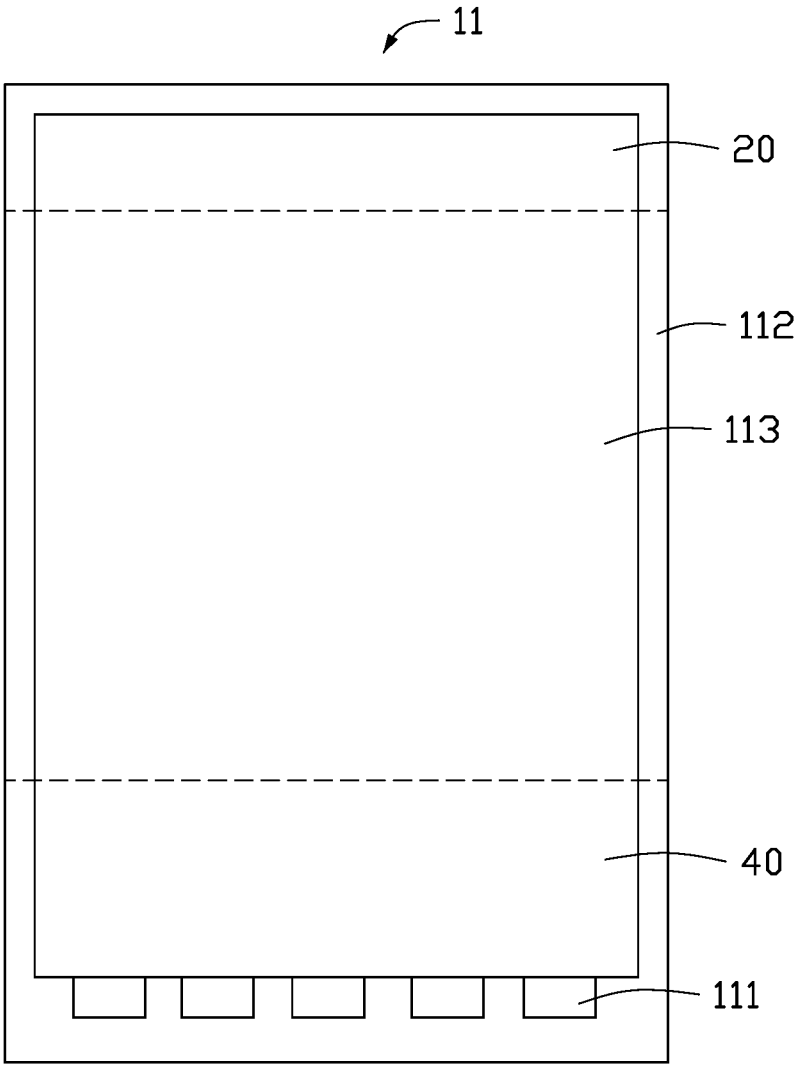
FIG. 2 is a diagram of an embodiment of a display screen.

Referring to FIG. 2, the display screen 11 includes a backlight source 111, a display module 112 and a light guide plate 113. The display module 112 can be a liquid crystal module. The backlight source 111 being set at one side of the display module 112, the light guide plate 113 guiding light emitted from the backlight source 111 to light the display module 112. The light from the backlight source 111 can be converted from a point source or a line source to a surface source under the action of the light guide plate 113.

In this embodiment, the backlight source 111 can be of various types, such as electro-luminescent, a cold cathode fluorescent lamp, or a light emitting diode.

The display module 112 includes multiple pixels. In this embodiment, the pixels includes at least one light-leaking pixel, the light-leaking pixel is a pixel at the light-leaking position of the display screen 11. Light-leaking is a phenomenon of uniform brightness of the display screen 11. The phenomenon is caused by the light of the backlight source 111 scattering at the edge of the display screen 11, or the brightness of the light-leaking pixel is higher than brightness of other pixels caused by the high brightness of the backlight source 111 itself. The pixel or pixels of the light-leaking position may occur around the display screen 11, at a corner of the display screen 11, or in irregular shapes visible on the display screen 11. For example, when the display screen 11 is a display screen of a certain shape, the light-leaking part may be specially cut part of the odd-shaped display screen, such as a depression or beveled surface of the screen.

The drive module 12 is configured for obtaining a light transmittance of each pixel according to color information of the same pixel.

The color information (for example, RGB information) of the pixels has a preset mapping relationship with the light transmittances of the pixels. The drive module 12 is prestored with a mapping table of the color information and the light transmittances of the pixels. By searching the mapping table, the light transmittance corresponding to the color information can be obtained. When the pixels comprise at least one light-leaking pixel, the mapping table of the color information and the light transmittance stored in the drive module 12 can be adjusted, so as to decrease the light transmittance of the at least one light-leaking pixel. The purpose of decreasing the light transmittance is to offset additional brightness of the at least one light-leaking pixel that is caused by light leaking of the at least one light-leaking pixel and achieve an approximately uniform display brightness of each pixel on the display module 112.

Figure 3:
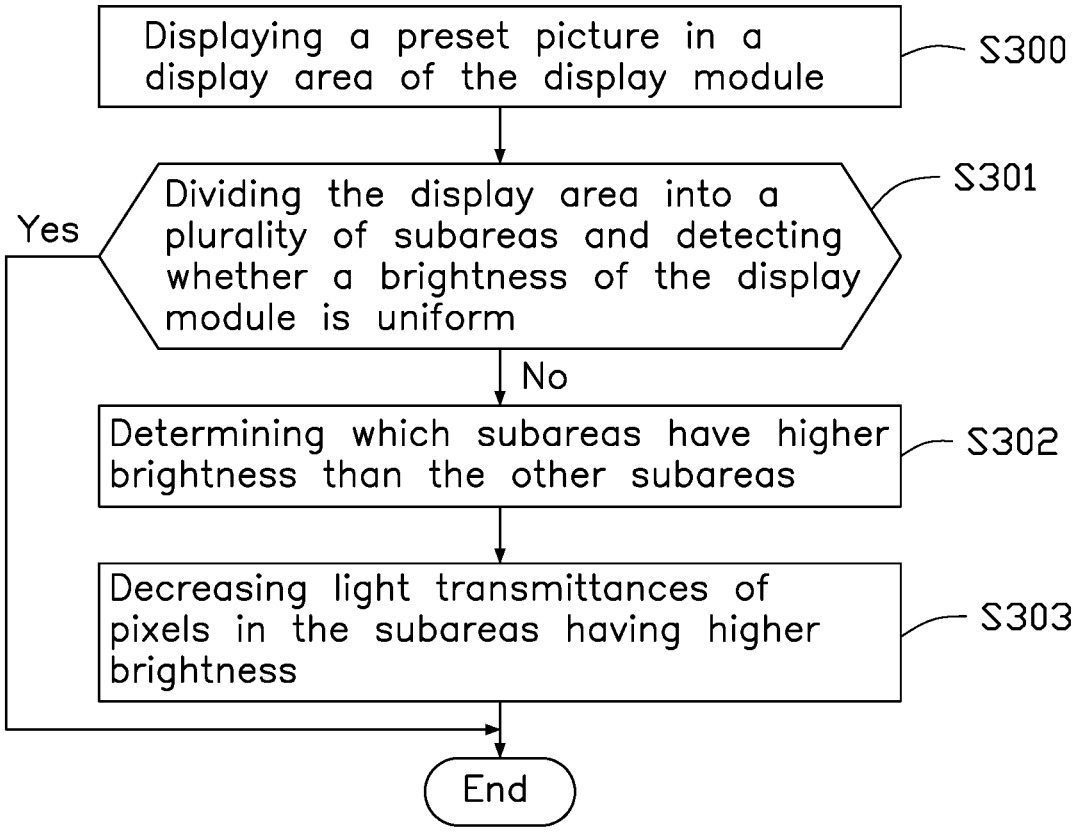
FIG. 3 is a flow diagram of an embodiment of a display screen adjustment method.

Referring to FIG. 3, a flowchart of an embodiment of display screen adjustment method is presented. The adjustment method is used post-production of the electronic device 10, or the electronic device 10 being returned to the factory. Each block shown in FIG. 3 represents one or more processes, methods, or subroutines, carried out in the method. Additionally, the illustrated order of blocks is by example only and the order of the blocks can be changed. The exemplary method can begin at block 300. Depending on the embodiment, additional steps can be added, others removed, and the ordering of the steps can be changed.

At block S300, displaying a preset picture in a display area of the display module 112.

In this embodiment, the preset picture can be a single color picture, for example, a wholly white or a wholly grey picture. In other embodiment, the preset picture also can be of multiple colors.

At block S301, dividing the display area into a plurality of subareas and detecting whether a brightness of the display module 112 is uniform. If uniform, the process is ended, if not enter into block S302. Block S301 is performed by a detecting device (not shown). The detecting device is a device that can detect whether the brightness of the display screen 11 is uniform.

In a first embodiment, the detecting device detects whether the brightness of the entire display area of the display module 112 is uniform. The detecting device divides the entire display area of the display module 112 into a plurality of subareas, each subarea contains a certain number of the pixels, and detects the brightness of the pixels of the subareas. The brightness of the pixels of each subarea is determined as being uniform or otherwise. The detections applied to the entire display area of the display module 112 is more accurate.

In a second embodiment, for faster detection, the detecting device can detect whether the brightness of only a part of the display area of the display module 112 is uniform. For example, the detecting device can detect whether the brightness of a preset area of the display module 112 is uniform. The preset area can be a first edge area 20 of the display screen 11 positioned opposite to a backlight source 111 of the display module 112. Referring to FIG. 2, the detecting device divides the first edge area 20 of the display module 112 into a plurality of subareas and detects the brightness of the pixels of the subareas, and determines whether the brightness of the pixels of each subarea is uniform. For a subarea which is not uniform, determining a high brightness or otherwise. The result of detecting the first edge area 20 of the display module 112 is achieved more quickly.

Figure 4:
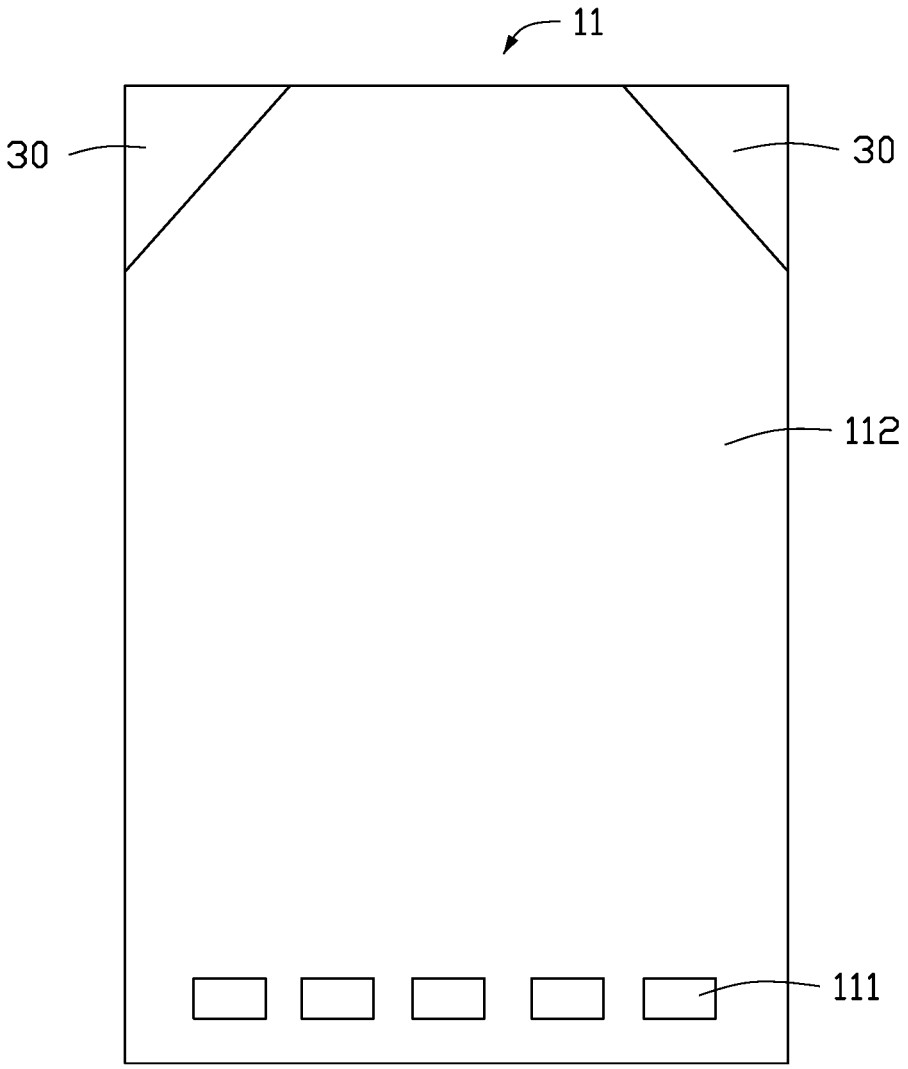
FIG. 4 is a diagram of an embodiment of an odd-shaped display screen.

In a third embodiment, referring to FIG. 4, when the display screen 11 is an odd-shaped display screen, the preset area can be a second edge area 30 of the display module 112. The second edge area 30 is positioned in a direction which is non-parallel with and non-perpendicular to a light transmission direction of a light guide plate 113 of the display module 112. The detecting device 200 divides the second edge area 30 of the display module 112 into a plurality of subareas, and detects whether the brightness of the pixels of each subarea is uniform. If not uniform, a determination as to high brightness of the subarea is made.

In a fourth embodiment, referring to FIG. 2, the preset area can be a third edge area 40 in which the distance between the third edge area 40 and a backlight source of the display module 112 is less than a preset value. The detecting device 200 divides the third edge area 40 of the display module 112 into a plurality of subareas, and detects whether the brightness of the pixels of each subarea is uniform. A determination as to high brightness is also made if not uniform. The result of detecting the third edge area 40 of the display module 112 is achieved more quickly.

At block S302, determining which subareas have higher brightness than the other subareas.

In this embodiment, the detecting device detects and compares the brightness of each subarea, and selects the subareas having higher brightness, to determine the positions of light-leaking subareas.

At block S303, decreasing light transmittances of pixels in the subareas having higher brightness. The drive module 12 can adjust the stored mapping table of the color information and the light transmittance, so as to decrease the light transmittances of the pixels in the subareas that have higher brightness.

Figure 5A:
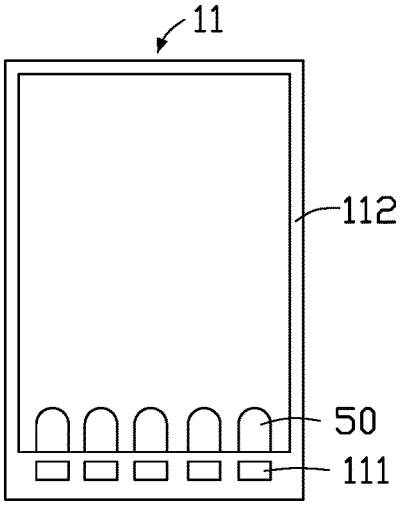
FIG. 5A, FIG. 5B and FIG. 5C illustrate visible effects of display screen adjustment method in an embodiment.
Figure 5B:
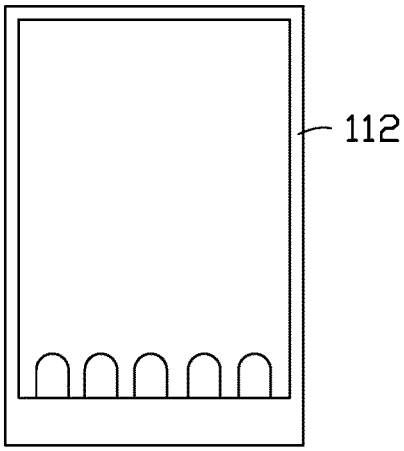
Figure 5C:
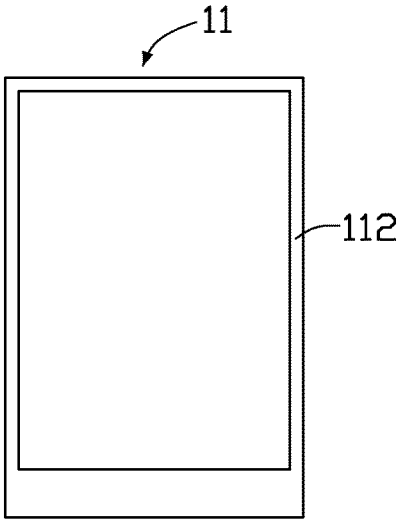

Referring to FIG. 5A, although the brightness of the display screen 11 is uniform, a light-leaking position is found at a fourth edge area 50 near the backlight source 111. Referring to FIG. 5B, the drive module 12 reduces the light transmittances of the pixels in the fourth edge area 50 to counteract the high brightness caused by light-leakage. Referring to FIG. 5C, each pixel has approximately same display brightness on the display screen 11.

It is to be understood, however, that even through numerous characteristics and advantages of the present disclosure have been set forth in the foregoing description, together with details of assembly and function, the disclosure is illustrative only, and changes may be made in details, especially in the matters of shape, size, and arrangement of parts within the principles of the disclosure to the full extent indicated by the broad general meaning of the terms in which the appended claims are expressed.

What is claimed is:

1. An electronic device, comprising:

a display screen, comprising a backlight source, a light guide plate and a display module, the backlight source being set at one side of the display module, the light guide plate guiding light emitted from the backlight source to light the display module, and the display module comprising multiple pixels; and a drive module, configured for controlling a light transmittance of each of the pixels, and controlling the display module to display a preset picture;

when the pixels comprise at least one light-leaking pixel, the drive module is configured for decreasing the light transmittance of the at least one light-leaking pixel to offset additional brightness of the at least one light-leaking pixel that is caused by light leaking of the at least one light-leaking pixel;

wherein the drive module is configured for obtaining the light transmittance of each pixel according to color information of the same pixel;

wherein the drive module converts the color information of each pixel to the light transmittance of the same pixel according to a preset mapping relationship between the color information of the pixels and the light transmittances of the pixels.

* * * * *